United States Patent [19]

Buergel

[11] 3,994,135

[45] Nov. 30, 1976

[54] THERMAL POWER ENGINE WITH A SEPARATE HEATING CHAMBER

[76] Inventor: Georg Karl Buergel, 6 Stone Road, Plainview, N.Y. 11803

[22] Filed: Jan. 15, 1975

[21] Appl. No.: 541,132

Related U.S. Application Data

[63] Continuation-in-part of Ser. No. 377,502, July 20, 1973, abandoned.

[52] U.S. Cl. ..... 60/516; 91/392

[51] Int. Cl.[2] ..... F02G 1/02

[58] Field of Search ..... 60/516, 517, 650, 682; 91/392

[56] References Cited

FOREIGN PATENTS OR APPLICATIONS 10,676 5/1908 United Kingdom ..... 60/516

761,122 11/1956 United Kingdom ..... 60/508

*Primary Examiner*—Allen M. Ostrager

[57] ABSTRACT

A combustion engine is provided comprising a housing; a cylinder defined within the housing and a piston disposed for movement within the cylinder. A heating chamber is also defined within the housing separated from the cylinder. The heating chamber includes a fuel inlet and fuel igniting means. A passageway extends between the heating chamber and cylinder and means disposed for movement with the piston is provided for covering and uncovering the passageway during selective portions of the engine cycle to provide a flow path from the heating chamber to the cylinder.

6 Claims, 4 Drawing Figures

THERMAL POWER ENGINE WITH A SEPARATE HEATING CHAMBER

This application is a continuation-in-part of Ser. No. 377,502, filed July 20, 1973, now abandoned.

BACKGROUND OF THE INVENTION

The present engine relates to combustion engines and more particularly to an improved combustion engine wherein a heating chamber separated from the engine cylinder is provided.

Heretofore, the various forms of combustion engines that have been developed heat their working gas by burning fuel within the engine cylinder. Burning occurs during a short period which requires a new ignition during each cycle. In the Otto-engine, ignition of the gasoline fuel is provided by an electric spark. In the Diesel-engine, ignition occurs by introduction of heated air. The Otto cycle ignition requires a rich mixture of fuel to air resulting in incomplete combustion and hence carbon monoxide in the exhaust gases. Similarly, the Diesel-engine combustion tends to create various oxides of nitrogen in the exhaust gases.

Needless to say, the exhaust gas oxides are undesirable and it is the principal object of the present invention to provide an improved combustion engine in which the fuel burning occurs under conditions which minimize or eliminate unwanted oxides.

SUMMARY OF THE INVENTION

The above and other beneficial objects and advantages are attained in accordance with the present invention by providing an improved combustion engine comprising a housing; a cylinder defined within the housing and a piston disposed for movement within the cylinder. A heating chamber is also defined within the housing separated from the cylinder. The heating chamber includes a fuel inlet and fuel igniting means. A passageway extends between the heating chamber and cylinder and means disposed for movement with the piston is provided for covering and uncovering the passageway during selective portions of the engine cycle to provide a flow path from the heating chamber to the cylinder at the end of the compression stroke.

DETAILED DESCRIPTION

Figure 1:
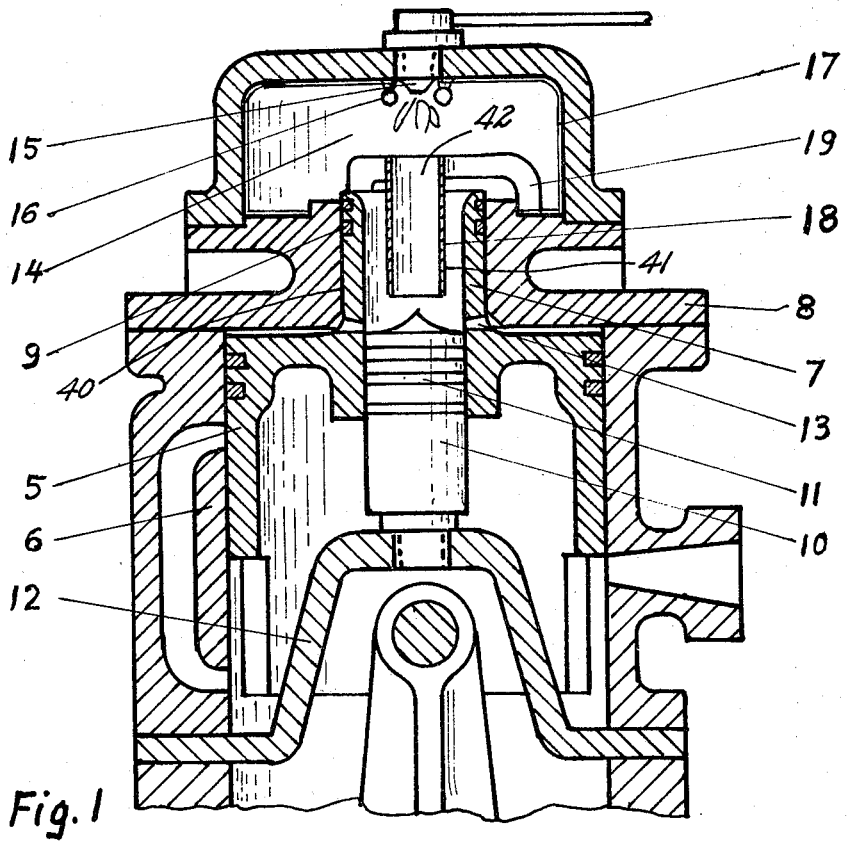
FIG. 1 is a fragmentary simplified sectional view of a first embodiment of a two-stroke engine in accordance with the present invention.

Reference is now made to the accompanying drawings wherein similar components bear the same reference numeral throughout the several views. In FIG. 1, a two-stroke-cycle engine is shown comprising a housing defining therein a cylinder the wall of which is generally designated by the numeral 6. A piston 5 is disposed for movement within the cylinder and, in FIG. 1, is shown in its highest position. A tubular extension

7 of the piston extends from the top surface of the piston. A cylindrical bore 40 extends through the top of head 8 of the cylinder and the extension 7 moves in and out of the passageway bore 40 as the piston 5 moves. Suitable piston rings 9 seal the extension to the bore 40 in the piston head while conventional rings (not numbered) seal the piston 5 with the cylinder wall.

A cylindrical member 10 is mounted to a stationary support 12 within the housing aligned with the bore of the tubular extension 7 which continues through the head of piston 5 as shown. Member 10, in effect, forms a stationary piston about which the cylindrical opening in the tubular extension and piston head move. Piston rings 11 provide a seal between member 10 and the surfaces defining the bore through the piston head and tubular extension.

Several openings or slits 13 are provided in the tubular extension 7 close to the flat portion of piston head 5 defining the interface between the piston head and tubular extension. In the upper position of piston 5, the openings 13 define a path between the engine cylinder and the tubular extension bore. As will be apparent from considering FIG. 1, as piston 5 continues to move down on member 10, the openings 13 are eventually closed and sealed.

The engine housing further comprises a heating chamber 14 defined above cylinder head 8. A passageway 41 is defined between the interior of the cylinder and the heating chamber by the opening through which tubular extension 7 extends. The passageway 41 through the extension and slits 13, however, provide a flow path between the heating chamber and cylinder which is closed during select portions of the engine cycle by virtue of the fixed piston 10 acting as a sliding valve periodically sealing the opening.

A fuel inlet nozzle 15 extends through the top wall of the heating chamber. An igniter 16 is closely spaced about the inlet nozzle and serves to ignite fuel introduced through the nozzle.

The inside walls of chamber 14 are covered with a low heat conducting material 17 such as a ceramic or several layers of this sheets of chrome steel.

A tube 18 is mounted to extend through the passageway 41 in extension 7 of the cylinder head 8 as shown. The tube is secured in place by legs 19 which, along with the tube, are formed of low heat conducting material. The operation and purpose of the tube will be discussed forthwith.

Figure 2:
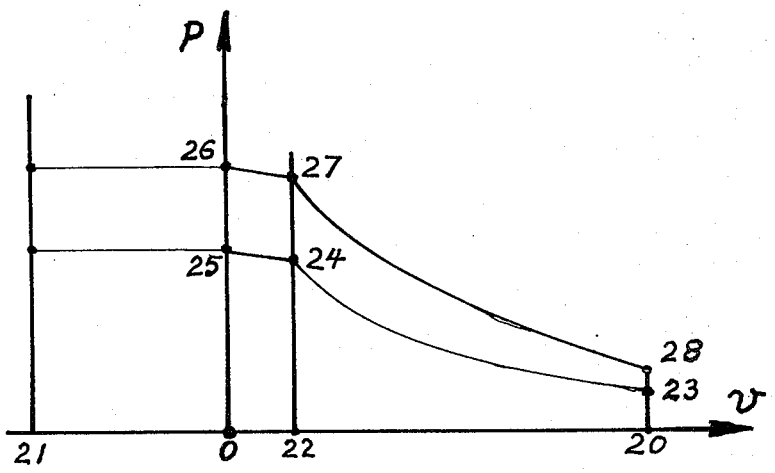
FIG. 2 is a pressure-volume diagram of the two-stroke engine.

FIG. 2 is a pressure-volume diagram for the operation of the engine of FIG. 1. The "zero" position indicates the cylinder volume at the time piston 5 is in its uppermost position (as shown in FIG. 1). Position 20 depicts the volume of the cylinder at the start of compression when the piston is in its downmost position. The space between the 0 position and 21 indicates the volume of heating chamber 14 and position 22 indicates the volume within the cylinder at the opening of slits 13 defining the path between the heating chamber and cylinder interior.

Point 23 represents atmospheric pressure. Point 24 denotes the pressure after a compression to about 1/6 the initial volume within the cylinder corresponding to position 22. At this time, the temperature of the gas (which, on a hot day at point 23, may be 27° C or 300° K) will have risen to about 327° C or 600° K and the pressure will have risen to 12 ata (kg/cm$^2$ absolute) which is point 24 on the diagram. At this position, the path between the heating chamber and cylinder interior opens and compressed gas starts flowing into the heating chamber so that after several strokes of the engine (during start-up) the pressure within the heating chamber will also reach 12 ata. As the piston 5 moves further up the air within the chamber above piston 5 is pushed into the heating chamber 14 causing a slight increase in the pressure within the heating chamber to point 25. As long as no heat is supplied to the air in the heating chamber 14, the pressure will stay close to 12 ata and when the piston moves downwardly, the same amount of air which was pushed into the chamber follows the piston out of the chamber until it is cut off at position 22 by virtue of slit 13 closing. The air expands to position 20 to atmospheric pressure at point 23. This cycle repeats itself as long as no heat is supplied to the air in the heating chamber and the engine is driven by the starter.

However, in accordance with the present invention, heat is supplied in the heating chamber. By supplying heat to the compressed air in the heating chamber by burning fuel or otherwise (as by supplying heat indirectly through heater tubes) the temperature in the chamber increases to, for example, 527° C or 800° K. The pressure in the chamber rises to about 15 ata to point 26 in the diagram of FIG. 2. As the piston 5 starts to compress from points 23 through 24 and the slits 13 open, heated air from chamber 14 will flow out of the chamber quickly raising the pressure above the piston to 15 ata at point 27. Piston 5 has to overcome the higher pressure to drive the air in front of it into chamber 14 to point 26 in FIG. 2. The air in front of the piston is cooler and it flows with high velocity through the open center 42 of tube 18 which directs the air to the heating flame above the tube. The jet action of this air stream insures that when the piston 5 reverses its direction of motion and air flows back from the chamber 14 into the cylinder, mostly hot air enters the cylinder through the tubular extension 7 outside of the tube 18 (from point 26 to point 27) i.e., not through the open center 42. After the slits 13 are once again closed the gases in front of the piston expand with the pressure indicated at point 27 which decreases to that indicated at point 28 at the end of the piston stroke. The area between the points 23, 24, 27 and 28 represent the output of mechanical energy of the engine.

The theoretical thermal efficiency of the above described process is about 50% if the compression temperature is brought up to 600° K from 300° K. The ideal operation described above may not occur since some of the cool air forced into chamber 14 will flow out of the chamber but even if the temperature in the chamber is higher than the average temperature of the air flowing from the chamber back into the cylinder, the pressure inside the heating chamber will adjust according to the temperature of the air flowing out.

The power output of the engine has to be regulated by controlling the heat supply to the heating chamber. A throttle in the exhaust tube can be used for emergency stops.

Figure 3:
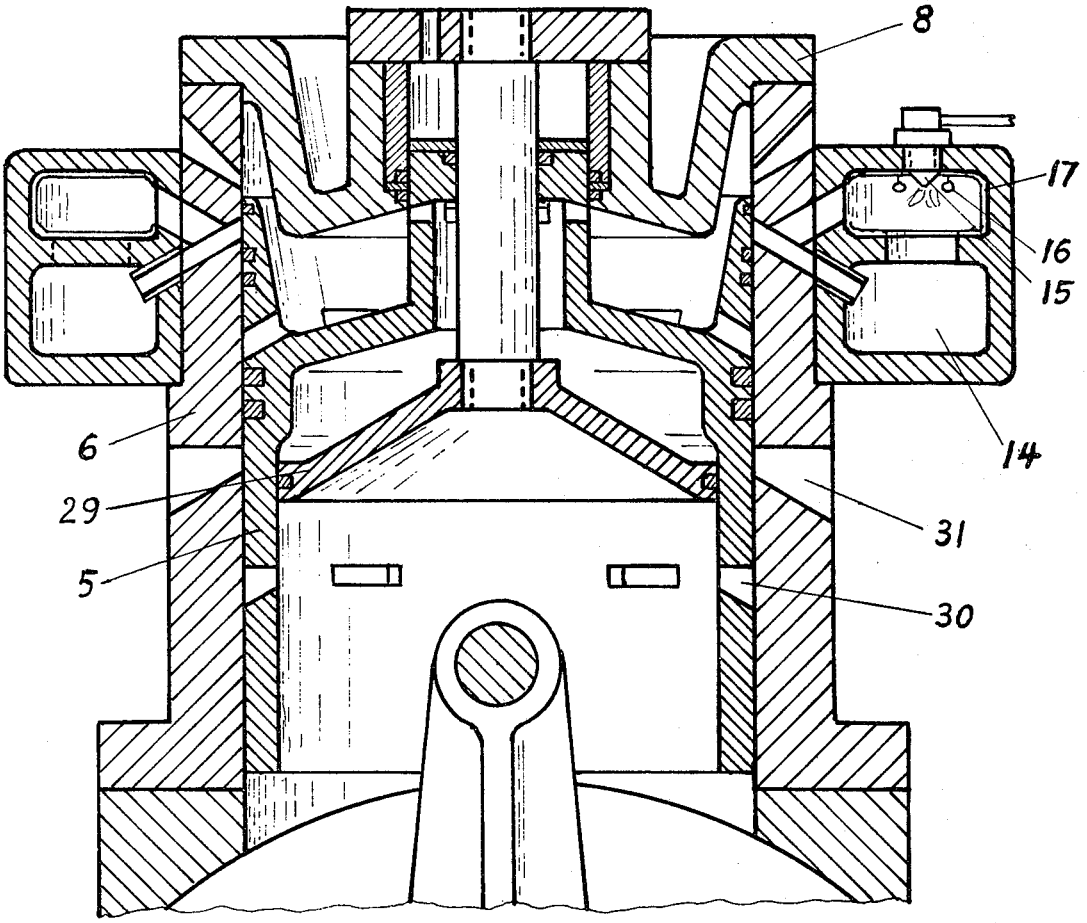
FIG. 3 is a view similar to FIG. 1 depicting a second embodiment of my invention; and, FIG. 4 is a schematic drawing depicting the manner of adapting the present invention to a four-stroke engine.

In FIG. 3 a slightly modified embodiment of my invention is depicted. The piston is here shown in the down position. In this embodiment, the heating chamber forms a complete or partial circumferential ring about the cylinder. The loading of fresh air is done by a pump which consists of a stationary piston 29 located within the working piston 5. Slits 30 in the wall of piston 5 act as sliding valves to permit the intake of fresh air when the slits 30 line up with openings 31 in the engine housing. The piston 5 is also formed with raised extensions which wipe the surfaces of the cylinder wall to open and close the passages (not numbered) between the heating chamber 14 and cylinder interior. In other respects, this embodiment of the invention operates in the manner previously described except that the fresh air is delivered from the pump to the cylinder through a tubular extension at the center of the piston.

Figure 4:
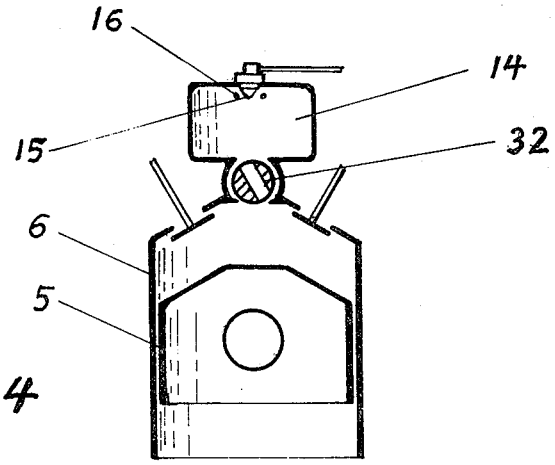

FIG. 4 discloses in schematic view how the present process can be used in a four-stroke-cycle engine. To this end, a rotating or sliding valve 32 governed by the engine cam shaft has to open and close the connecting path between the cylinder and heating chamber.

To conserve energy, the inside of the cylinder head as well as the piston head should be covered with a low heat conducting material.

Having thus described my invention, what is claimed is:

1. A combustion engine comprising a housing; a cylinder defined within said housing; a piston disposed for movement within said cylinder; a heating chamber defined within said housing; a fuel inlet and fuel igniting means disposed within said heating chamber; a passageway disposed within said housing connecting said heating chamber and said cylinder interior; means disposed for movement with said piston for opening said passageway when said piston is at the end portion of its stroke to provide a flow path from said heating chamber to said cylinder whereby the gases within said cylinder pass into said heating chamber through said passageway at the end of the compression stroke and return from said heating chamber to said cylinder through said passageway at the beginning of the down stroke of said piston in a reciprocating motion.

2. The combustion engine in accordance with claim 1 further comprising means disposed in said passageway for directing gases from said cylinder into said heating chamber at said igniter means.

3. The combustion engine in accordance with claim 1 wherein said means comprises: a tubular extension of said piston disposed for movement within said passageway as said piston moves within said cylinder; a transverse slit defining an opening through said tubular extension; and closure means for said opening fixed in the path of movement of said tubular extension whereby during the end portion of the compression stroke of said piston said opening is uncovered to provide a flow path from said heating chamber through said passageway, tubular extension and opening into said cylinder at the end of said compression stroke.

4. The combustion engine in accordance with claim 1 wherein said housing defines a top surface for said cylinder, said heating chamber is disposed above said top surface, said cylindrical extension through said top surface, said piston includes a piston top surface, said tubular extension extends upwardly from said piston top surface defining an interface therewith; and said passageway opening is disposed at the interface of said tubular extension and piston top surface.

5. The combustion engine in accordance with claim 1 wherein said closure means comprises a cylindrical member mounted interiorly of said piston aligned with said tubular extension, said cylindrical member having a top surface in line with said piston top surface when said piston is at the top of its stroke, whereby as said piston moves downwardly said tubular extension slides over said cylindrical closure.

6. The combustion engine in accordance with claim 5 wherein said heating chamber extends circumferentially about said cylinder separated from said cylinder by a cylinder wall; said passageway extends through said cylinder wall; and said means for covering and uncovering said passageway comprises portions of said piston in the form of a collar extending upwards from the flat bottom of the piston and having slits disposed at the interface of said collar and the flat bottom of the piston.

* * * * *